US006938275B1

(12) United States Patent
Fried

(10) Patent No.: US 6,938,275 B1
(45) Date of Patent: Sep. 6, 2005

(54) WRIST BAND CONSTRUCTION FOR BALLOONS

(76) Inventor: Brian Fried, 9 Richborne La., Melville, NY (US) 11747

( * ) Notice: Subject to any disclaimer, the term of this patent is extended or adjusted under 35 U.S.C. 154(b) by 0 days.

(21) Appl. No.: 10/957,450

(22) Filed: Oct. 1, 2004

(51) Int. Cl.[7] ..... A41D 19/00
(52) U.S. Cl. ..... 2/162
(58) Field of Search ..... 2/16, 17, 20, 160, 2/162, 170; 84/402, 468; 446/397, 415, 417–421; 473/506–508

(56) References Cited

U.S. PATENT DOCUMENTS

| | | | | |
|---|---|---|---|---|
| 667,563 | A * | 2/1901 | Oakley | 473/424 |
| 3,940,133 | A * | 2/1976 | Civita | 473/424 |
| 4,273,275 | A | 6/1981 | Vadnais | 224/101 |
| 4,733,808 | A | 3/1988 | Turner, Jr. et al. | 224/219 |
| 5,011,447 | A | 4/1991 | Watanabe | 446/220 |
| 5,094,462 | A * | 3/1992 | Boyle et al. | 473/576 |
| D350,314 | S | 9/1994 | Schweitzer | D8/200 |
| 5,823,840 | A * | 10/1998 | Powers | 441/122 |
| 5,853,339 | A * | 12/1998 | Scerbo | 473/576 |
| 6,029,321 | A | 2/2000 | Fisher | 24/306 |
| 6,685,582 | B2 * | 2/2004 | Abel | 473/508 |
| 6,807,822 | B1 * | 10/2004 | Martinson | 63/1.13 |
| 6,834,610 | B2 * | 12/2004 | Beaham, III | 116/200 |

FOREIGN PATENT DOCUMENTS

| | | | |
|---|---|---|---|
| FR | 2543714 | * 10/1984 | G08B 5/00 |

* cited by examiner

*Primary Examiner*—Gary L. Welch
(74) *Attorney, Agent, or Firm*—Sturm & Fix LLP

(57) ABSTRACT

A wrist band construction (10) for connecting at least one helium filled balloon (100) provided with a tether (101) to the wrist of a child wherein, the wrist band construction (10) includes a wrist band member (20) fabricated from a strip of heavy material (21) and provided with a pivoting D-ring member (30) that is adapted to make audible contact with a pair of metal rods (40) (40) disposed on the wrist band member (20) on the opposite sides of the D-ring member (30).

4 Claims, 1 Drawing Sheet

WRIST BAND CONSTRUCTION FOR BALLOONS

CROSS REFERENCE TO RELATED APPLICATIONS

Not applicable.

BACKGROUND OF THE INVENTION

1. Field of the Invention

The present invention relates to the fields of both wrist bands, as well as, balloon holders in general and in particular to a combined wrist band and balloon holder device.

2. Description of Related Art

As can be seen by reference to the following U.S. Pat. Nos. 4,733,808; 5,011,447; Des. 350,314; U.S. Pat. No. 4,273,275; and, U.S. Pat. No. 6,029,321, the prior art is replete with both wrist band constructions, as well as, balloon tethering arrangements.

While all of the aforementioned prior art constructions are more than adequate for the basic purpose and function for which they have been specifically designed, they are uniformly deficient with respect to their failure to provide a simple, efficient, and practical combined wrist band and balloon tethering construction which is specifically designed not only to tether a balloon securely to a child's wrist, but also to have sufficient weight to prevent a helium filled balloon from flying away should the wrist band become disengaged from a child's wrist.

As any parent is all too well aware, small children and helium filled balloons seem predestined to have a very brief relationship with one another before the balloon is accidentally set free to ascend to balloon heaven leaving behind a crying child and a distraught parent or caregiver who purchased the balloon only a short time before.

As a consequence of the foregoing situation, there has existed a longstanding need among parents and caregivers for a new and improved combined wrist band and balloon tether construction which forms a secure connection between a child and a helium balloon to prevent the premature escape of the balloon from the child's control and the provision of such a construction is the stated objective of the present invention.

BRIEF SUMMARY OF THE INVENTION

Briefly stated, the wrist band for balloons that forms the basis of the present invention comprises in general a wrist band member, a balloon tether member that is pivotally secured to the wrist band member, and a pair of metal contact bars that are aligned within the arc of rotation of the pivoting balloon tether member to distract the child from releasing the balloon strings from the tether member.

As will be explained in greater detail further on in the specification, both the wrist band member and the balloon tether member are chosen to provide a combined weight that will counteract the lifting effect of one or more helium balloons so that the balloons cannot carry the wrist band member and the balloon tether member away in the event that the child disengages the wrist band member from their wrist.

Furthermore, in an effort to discourage a child from untying a balloon string from the balloon tether member, this invention positions a pair of metal contact rods on the opposite sides of the pivoting balloon tether member such that a metal clacking sound will be generated as a child twists the wrist from side to side.

This feature not only distracts the child's attention from the point of connection between the balloon string and the balloon tether member, but also encourages, particularly small boys, to wear the wrist band construction even when balloons are not connected thereto.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
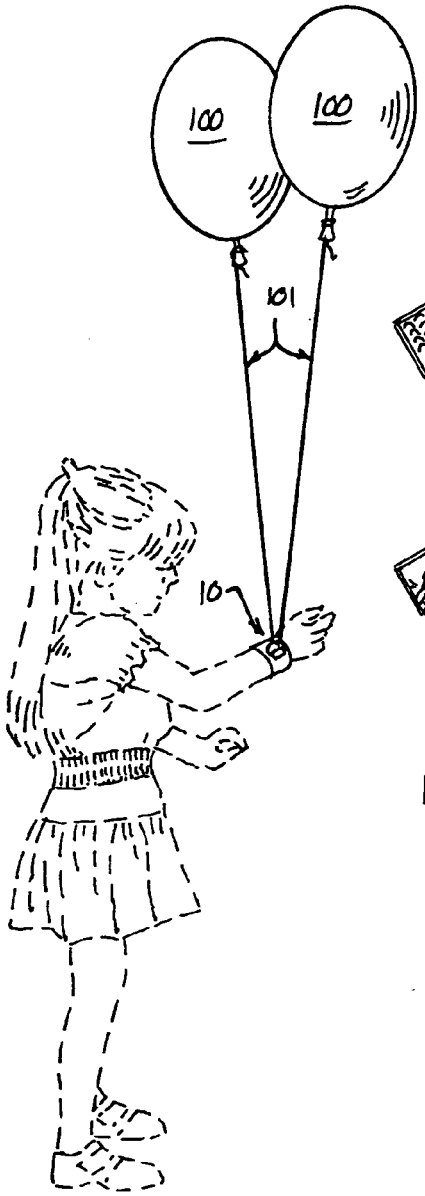
FIG. 1 is a perspective view of the wrist band construction in use.
Figure 4:
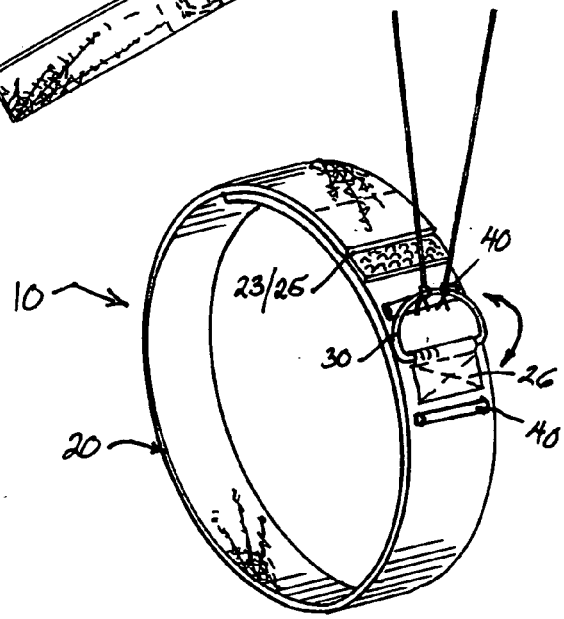

As can be seen by reference to the drawings, and in particular to FIGS. 1 and 4, the wrist band construction that forms the basis of the present invention is designated generally by the reference number 10. The construction 10 comprises in general a wrist band member 20, a balloon tether member 30, and a pair of metal contact rods 40 40. These structural components will now be described in seriatim fashion.

Figure 2:
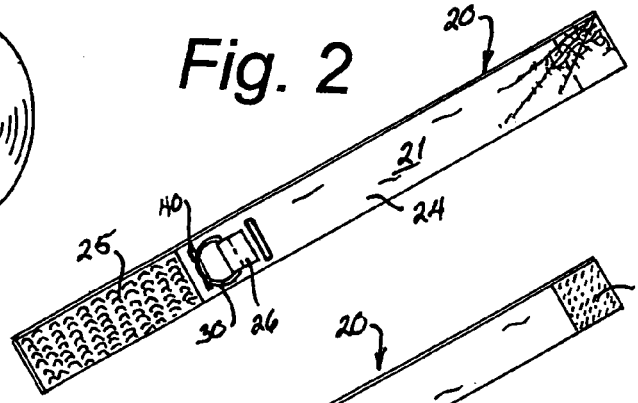
FIG. 2 is a perspective view of the top surface of the wrist band construction.
Figure 3:
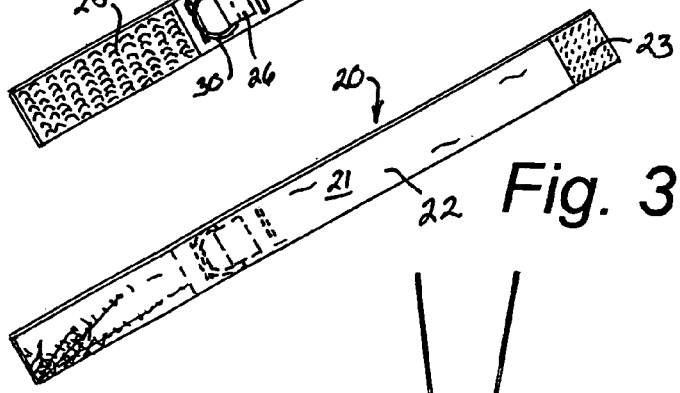
FIG. 3 is a perspective view of the bottom surface of the wrist band construction; and, FIG. 4 is a perspective view of the wrist band construction in its operative closed loop configuration.

As shown in FIGS. 2 and 3, the wrist band member 20 is fabricated from a flexible strip of heavy material 21 such as thick woven nylon or leather or the like having a weight that measures in the amount of several ounces.

In addition, the bottom surface 22 of the wrist band member 20 has one end provided with one of the components 23 of a hook and loop fastener while the top surface 24 of the wrist band member 20 has an opposite end provided with the other component 25 of a hook and loop fastener.

Furthermore, the top surface 24 of the wrist band member 20 is further provided with a hinged loop element 26 that is adapted to engage the balloon tether member 30 which comprises a metal D-ring member that is pivotally associated with the hinged loop element 26 in a well recognized fashion.

Turning now to FIGS. 2 and 4, it can be seen that the pair of metal rods 40 40 are positioned on the opposite sides of the metal D-ring member 30 and within the pivoting arc of rotation of the D-ring member 30 such that as a child flicks their wrist from side to side, the D-ring member 30 will make an audible sound as it contacts one and then the other of the pair of metal rods 40 40.

Returning to FIG. 1, it can be appreciated that one or more helium balloons 100 can be connected to the D-ring member 30 via strings or ribbons 101 wherein, the combined weight of the D-ring member 30, the metal rods 40 40 and the wrist band member 20 will have a minimum weight of 0.75 ounce to prevent the wrist band construction from floating away even when the wrist band construction 10 is not operatively connected to a child's wrist.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A wrist band construction for maintaining a child's wrist in operative engagement with at least on helium filled balloon provided with a tether wherein, the construction comprises a wrist band member fabricated from a strip of heavy material having opposed sides provided with cooperating fasteners; and, a balloon tether member comprising a ring member pivotally associated with one of the sides of the wrist band; and at least one metal rod disposed within the arc of rotation of the pivoting ring member.

2. The construction as in claim 1; wherein, said ring member has a generally D-shaped configuration.

3. The construction as in claim 2; further comprising at least one additional metal rod disposed within the arc of rotation of the pivoting ring member wherein, the ring member is disposed intermediate said at least one and said at least one additional metal rod.

4. The construction as in claim 1; wherein, the combined minimum weight of the wrist band member and the ring member is 0.75 ounce.

* * * * *